US005729843A

United States Patent [19]

Manthey

[11] Patent Number: 5,729,843

[45] Date of Patent: Mar. 24, 1998

[54] ASSEMBLY AND METHOD FOR MOVING A PERSON

[76] Inventor: Michael F. Manthey, 27785 Isaac Creek Rd., Huson, Mont. 59846

[21] Appl. No.: 659,294

[22] Filed: Jun. 4, 1996

[51] Int. Cl.[6] ..... A61G 7/10

[52] U.S. Cl. ..... 5/89.1

[58] Field of Search ..... 5/89.1, 81.1 R, 5/83.1, 85.1, 87.1, 86.1; 182/3, 7

[56] References Cited

U.S. PATENT DOCUMENTS

| | | | |
|---|---|---|---|
| 293,799 | 2/1884 | Simkin . | |
| 578,145 | 3/1897 | Girtler . | |
| 634,604 | 10/1899 | Asche . | |
| 1,536,766 | 5/1925 | Cammann . | |
| 1,876,832 | 9/1932 | Bancroft | 5/89.1 |
| 2,979,028 | 4/1961 | Zakely | 119/96 |
| 3,222,029 | 12/1965 | Hildemann | 254/8 |
| 3,234,568 | 2/1966 | Fischer | 5/89.1 |
| 3,623,169 | 11/1971 | James | 5/81 |
| 3,703,218 | 11/1972 | Brda | 182/6 |
| 3,869,021 | 3/1975 | Sutherland | 182/3 |
| 4,243,147 | 1/1981 | Twitchell et al. | 212/159 |
| 4,347,914 | 9/1982 | Gary | 182/142 |
| 4,440,261 | 4/1984 | Clark | 182/3 |
| 4,510,633 | 4/1985 | Thorne | 5/89.1 |
| 4,739,526 | 4/1988 | Hollick | 5/89.1 |
| 4,748,701 | 6/1988 | Marlowe et al. | 5/89.1 |
| 4,903,355 | 2/1990 | Hickerson | 5/89.1 |

*Primary Examiner*—Alexander Grosz
*Attorney, Agent, or Firm*—Wells, St. John, Roberts, Gregory & Matkin, P.S.

[57] ABSTRACT

As assembly for supporting and moving a person including a first portion which supports that part of the person's body below the waist; and a second portion which supports that part of the person's body above the waist, the second portion having first and second members which extend downwardly relative to the first portion, the first and second members releasably secured on the second portion.

18 Claims, 3 Drawing Sheets

ASSEMBLY AND METHOD FOR MOVING A PERSON

BACKGROUND OF THE INVENTION

1. Field of the Invention

The present invention generally relates to an assembly for moving and repositioning people who are not capable of walking or otherwise limited in their ability to move. More particularly, to an assembly which can be readily positioned relative to a non-ambulatory patient to move the patient to another location and which can be removed with minimal manipulation of the non-ambulatory patient, thereafter.

2. Description of the Prior Art

The problems associated with lifting and transporting non-ambulatory patients has long been recognized. The prior art is replete with various lifting and transporting slings, and other devices, which have been employed to move patients between beds, wheel chairs, and other living or treatment areas and positions. Devices such as what are shown in U.S. Pat. No. 3,234,568 to Fisher are illustrative of the types of slings which have been used.

While such slings and other devices have operated with varying degrees of success, they possess shortcomings which have detracted from their usefulness. For example, devices such as shown in U.S. Pat. No. 3,234,568 are normally left in place once the patient is moved from a bed to a destination, such as a wheel chair or other therapy area. Under some circumstances, such as with increased temperature and humidity, these slings can cause discomfort, or contribute to other deleterious physical conditions such as bed sores. Further, if these same slings are left in place for prolonged periods of time, they become soiled with tissue, microbes and other materials and are thereafter difficult to fully clean or otherwise return to a sanitary condition.

Still further, the devices such as shown in the Fisher patent are difficult to appropriately position underneath a patient because of their construction. Therefore, a nurse or other attendant would need to manipulate or otherwise lift the patient, under some circumstances, in order to appropriately position the sling for subsequent use.

Still further, other devices which have been used for substantially identical purposes have proven to be unsatisfactory because they do not support the back of the patient. Therefore, such devices have not gained widespread acceptance except for use with patients who have faculties for controlling their movement above the waist.

Therefore, it has long been known that it would be desirable to have an assembly for moving a person from one location to another and which is particularly well-suited for moving non-ambulatory patients, the device being easy to position relative to the patient and which further can be readily removed from the patient once the patient has been transported to the desired destination.

OBJECT AND SUMMARY OF INVENTION

It is therefore one of the objects of the present invention to provide an assembly for moving a person from one location to another.

Another object of the present invention is to provide a human lifting assembly which includes a first portion which supports that part of the person's body below the waist; and a second portion which supports that part of the person's body above the waist. The second portion having first and second members being constructed to extend downwardly along the patient's sides relative to the first portion. The first and second members are preferably releasably secured on the second portion, the given length dimension of the first and second members positioning the second portion in supporting relation relative to the part of the person's body above the waist when the first portion is positioned in supporting relation relative to that part of the person's body below the waist.

Another object of the present invention to provide an assembly for moving a person which can be employed with minimal risk of contamination or interference, during the use thereof in assorted medical procedures.

Another object of the present invention is to provide an assembly for moving a person which is of durable construction as virtually to preclude damage thereto during normal use, and which further can be conveniently positioned in supporting relation relative to the patient with minimal manipulation of the patient.

Another object of the present invention is to provide an assembly for moving a person which is constructed of relatively inexpensive materials. The present assembly can be cleaned to prevent possible transmission of disease or the infectious contamination of medical treatment areas by means of the assembly.

Another object of the present invention is to provide an assembly for moving the person which is characterized by ease of employment, simplicity of construction, and which further can be manufactured and sold at a nominal expense.

Another object of the present invention is to provide an assembly from moving a person which is operable to obtain the benefits derived from related prior art devices and practices while avoiding the detriments individually associated therewith.

Further objects and advantages of the present invention are to provide improved elements and arrangements thereof in an assembly for moving a person for purposes intended, which is dependable, economical, durable, and fully effective in accomplishing these intended purposes.

DESCRIPTION OF THE PREFERRED EMBODIMENT

This disclosure of the invention is submitted in furtherance of the constitutional purposes of the U.S. Patent Laws "to promote the progress of science and useful arts" (Article 1, Section 8).

Figure 1:
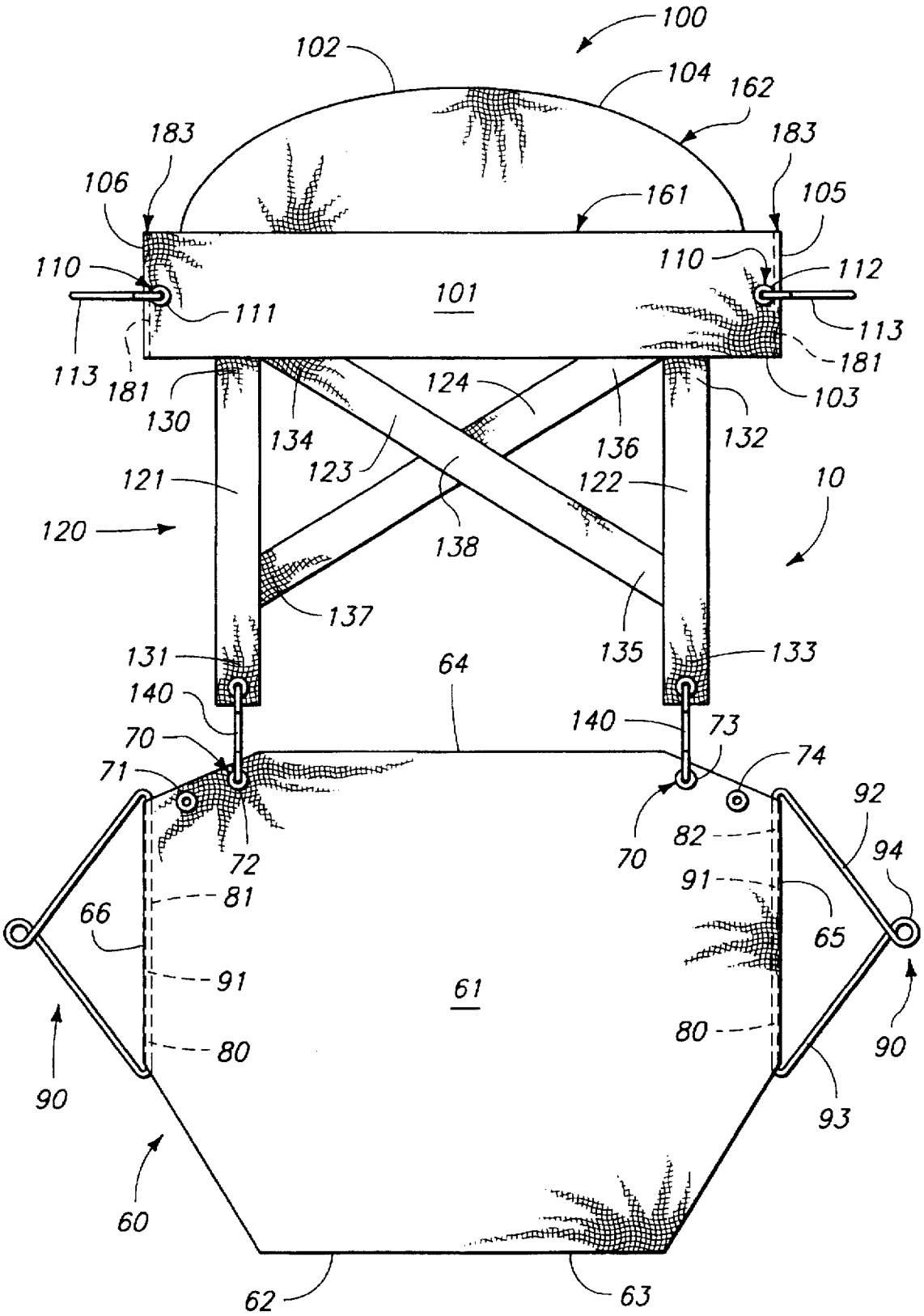
FIG. 1 is a plan view of a preferred assembly according to the present invention.

Referring more particularly to the drawings, the assembly for moving a person embodying the principles of the present invention is designated generally by the numeral 10 in FIG. 1.

For illustrative convenience only the present assembly 10 is shown and described herein as it would be configured if it were employed to move a non-ambulatory patient identified by the numeral 11.

As noted above, the assembly 10 is operable to support a person or patient 11 who has an upper body portion or torso 12 which extends above the patient's waist, and a lower body portion 13, which extends below the waist. Further, the patient has shoulders 14, a back 15, thighs 16, and a buttocks area 17.

The assembly for moving a person 11 works in combination with a lifting means or device which is sometimes referred to in the trade as a "Hoyer lift" 20. The lifting means 20 is operable to suspend and otherwise move or transport the patient 11. The lifting means 20 has a base portion 22 which movably rests on a supporting surface, such as directly on the surface or by means of casters (not shown). A frame member 23 is affixed thereto by utilizing conventional fastening techniques. The frame member extends substantially normally upwardly relative to the base portion 22, and further has a first end 24, which is affixed on the base portion 22, and an opposite second, or distal end 25 which is remote thereto. The second end defines a pivot point which is generally indicated by the numeral 26. A movable boom 30 is pivotally mounted at the pivot point 26, by a conventional fastener. The boom 30 has a main body 31, with a first end 32, which is pivotally affixed at the pivot point 26, and an opposite second or distal end 33, which is remote thereto. A loop or hook 34 is attached by a suitable fastener or by welding or the like on the distal end 33.

Figure 2:
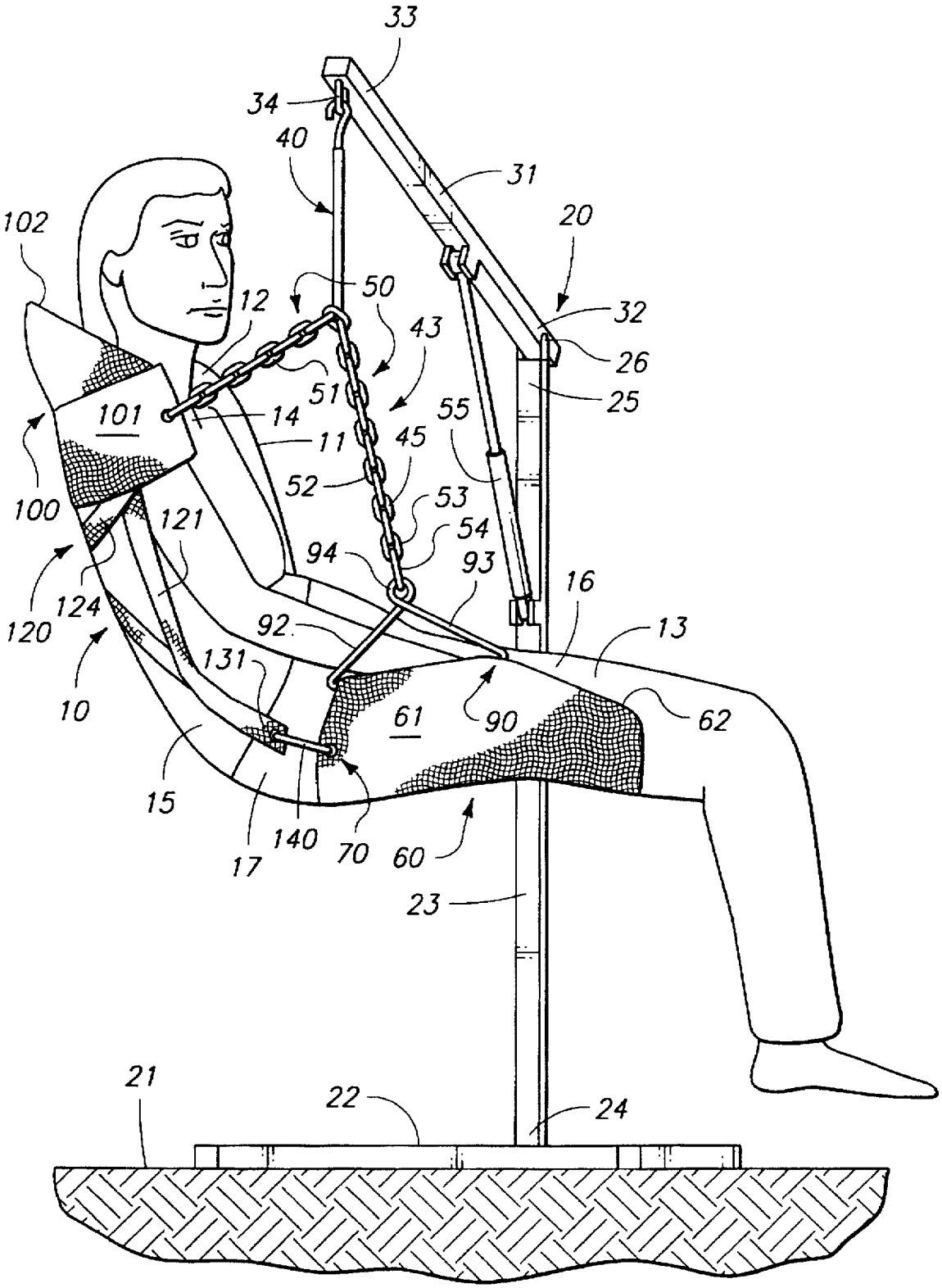
FIG. 2 is an environmental, side elevational view of the assembly of FIG. 1, shown supporting a patient.

Releasably affixed on the connector loop or hook 34 of the boom 30 is a lifting or spreader beam which is generally indicated by the numeral 40. The lifting beam has opposite first and second ends 41 and 42 respectively, the lifting beam 40 being connected or otherwise joined to the connector loop or hook 34 by means of a releasable fastener, such as the hook shown, which is positioned approximately intermediate its opposite ends. Releasably affixed on the first and second ends 41 and 42 are a pair of side chains identified by the numeral 43. The pair of side chains include a first side chain 44, and a second side chain 45. Each of the respective side chains is defined by a pair of discrete lengths of chain 50. These lengths of chain each include a first chain section, and a second chain section 51 and 52, respectively. As best seen in FIG. 2, the individual chain sections 51 and 52 have unequal length dimensions. This permits the assembly 10 to be positioned in an orientation that allows the patient to be placed in a sitting position. However, it will be recognized that by making the discrete chain sections substantially the same length, the assembly 10 will permit the patient 11 to be oriented in a more reclined position.

Each of the respective first and second chain sections 51 and 52 have a distal end 53 which has affixed thereto a releasable fastener 54 of conventional design. The releasable fastener 54 is operable to engage the assembly 10 in a fashion which will be discussed in greater detail hereinafter. A hydraulic cylinder 55, having an associated ram is mounted in force-engaging relation relative to the boom 30 and provides a means for urging the boom 30 along a predetermined, substantially arcuately shaped path of travel. This facilitates the location of the lifting beam 40 in an appropriate orientation to move the patient 11 to any number of different destinations based upon the desired treatment regimen.

As best seen by reference to FIG. 2, the assembly 10 for moving a person 11 includes a first portion generally indicated by the numeral 60. The first portion 60 has a flexible main body panel 61 which has a suitable length and width dimension. The width dimension of the flexible main body 61 normally is greater than the width dimension of the person for which it will be employed. As best illustrated by reference to FIGS. 2 and 3, it will be recognized that the width dimension of the first portion 60 allows the flexible main body 61 to cradle the lower portion 13 of the patient's body 11. In particular, the first portion 60 is operable to be positioned in supporting relation relative to the thighs 16 and buttocks area 17 of the patient 11. The flexible main body 61 is defined by a peripheral edge 62. The peripheral edge includes a first or front substantially truncated edge 63 and an opposite second or rear substantially truncated edge 64. Also included are left and right laterally disposed edges 65 and 66, respectively. The laterally disposed edges are positioned in substantially parallel, spaced relationship one to the ocher.

First portion 60 also includes a plurality of grommets 70 which are mounted in and borne by the main body 61, and are identified hereinafter as grommets 71, 72, 73 and 74, respectively. The first set of grommets are located along the second edge 64, and adjacent to the right laterally disposed edge 66. The second pair of grommets, 73 and 74, are also located along the second edge 64, and disposed adjacent to the left laterally disposed edge 65. The individual grommets define apertures having a predetermined diametrical size. The individual grommets 71 through 74 respectively are oriented a given distance apart. In this regard, the pair of grommets 71/72 and 73/74 respectively, are located at a distance which is approximately equal to the width of patient 11.

As best illustrated in FIG. 1, the flexible main body 61 also advantageously defines a pair of channels 80 which are positioned along the left and right laterally disposed edges 65 and 66. The pair of channels 80 include a first or left channel 82, and a second or right channel 83.

As best seen by reference to FIG. 1, a pair of lifting devices 90 are individually received in each of the channels 80. Each of the lifting devices 90 include first, second and third sections 91, 92 and 93 respectively. These sections are joined together to form a substantially triangular shape. The first sections 91 are received in channels 80. The second and third section of the respecting lifting devices 90 define an apex connection feature 94, such as in the form of the loops shown. The second chain section 52 of the individual side chains 43 are releasably connected to the individual lifting devices at the apex 94.

Assembly 10 also includes a second or upper portion or section 100 which supports upper portions of the patient's torso. The second portion has a flexible main body 101 which is defined by a peripheral edge 102. Peripheral edge 102 comprises a first edge 103, which is substantially linear in shape along its length. Further, the peripheral edge 102 includes a second edge 104, which is curved in shape along its length. Further, the peripheral edge 102 includes left and right lateral edges 105 and 106 respectively, which are oriented in substantially normal relation relative to the first edge 103 and are disposed in substantially parallel spaced relation one to the other.

The main body includes a transverse band section 161 and an upper hood section 162. The hood section aids in support of the head and neck when the patient is in a reclined position. The size, particularly height, of the hood portion can be increased to the patient's need. For patients requiring complete support of the head or neck, the hood will extend substantially higher than the construction shown in the Figs. The transverse band supports the upper back and shoulders.

A pair of grommets 110 are borne by the main body 101 to serve as attachment features. The grommets are individually positioned in close proximity to the left and right lateral edges 105 and 106, respectively, approximately midway between the first and second edges 103 and 104. The grommets include a first grommet 111, and a second groinmet 112. Attached to the first and second grommets are individual fasteners or hooks 113 of conventional design, such as loops or S-hooks. These fasteners are each operable to engage or disengage the respective first chain sections 51. This allows connection or disconnection of the upper portion 100.

The outer ends of the main body piece 101 are also preferably reinforced to better distribute the loading imposed through grommets from the connecting hooks 113 or other supporting links. As shown, this is accomplished using reinforcing edge pieces 181. Pieces 181 extend adjacent to the peripheral edges 105 and 106. The edges are preferably provided with receiving channels 183 which are formed by sewing a loop in the fabric or by using other suitable constructions. The load is then distributed across the width (height) of the transverse band section 161 using the edge pieces. Such pieces are preferably formed of steel or other suitably strong and relatively rigid material.

Figure 3:
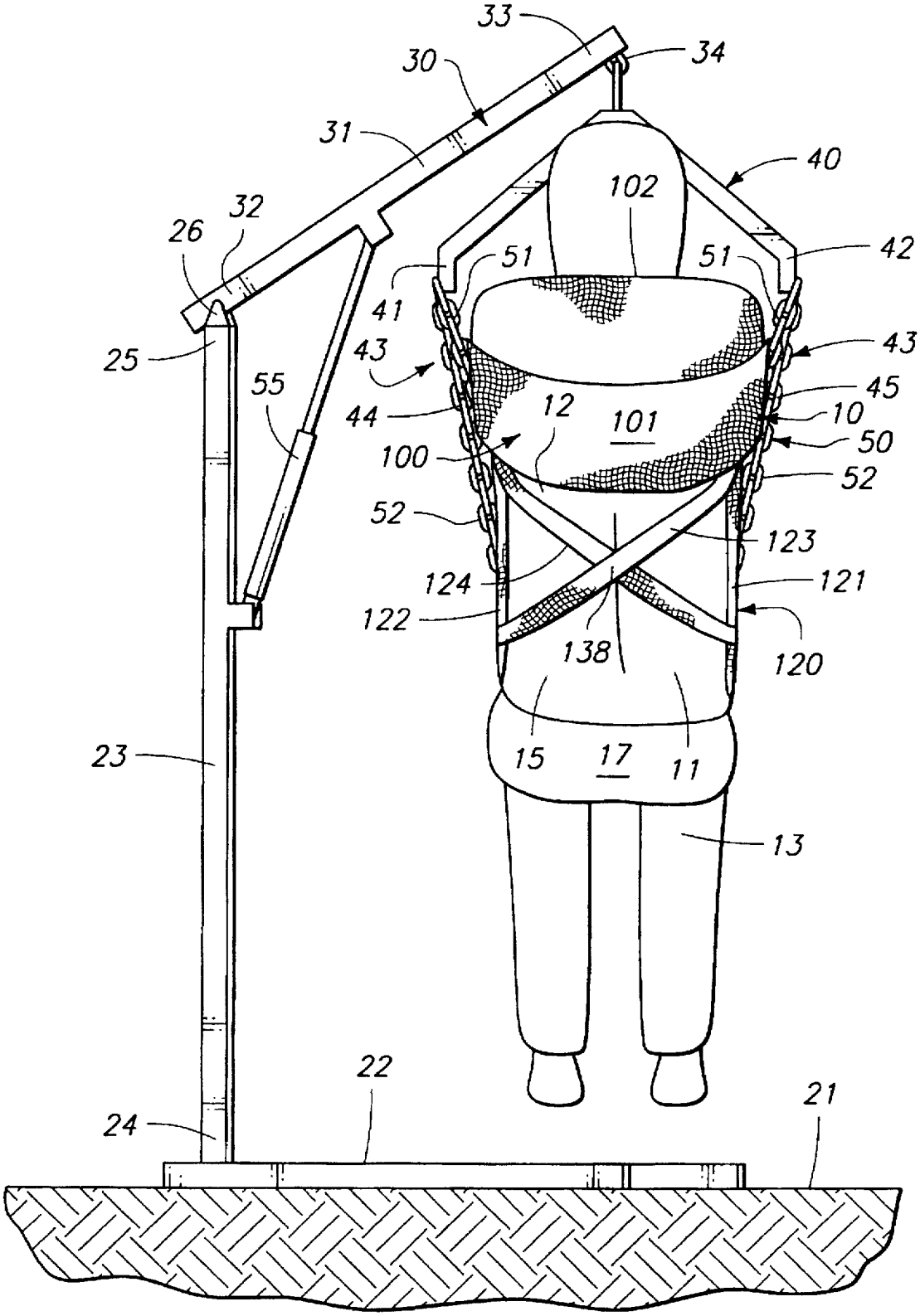
FIG. 3 is a rear elevational view of the assembly as shown in FIG. 2.

As best seen by reference to FIGS. 2 and 3, the assembly 10 has an intermediate or connection portion or section which is generally indicated by the numeral 120. The intermediate portion is specially configured to allow easy connection and disconnection of the upper portion 100 to the lower portion 60, even with the patient in sitting or laying postures. The intermediate portion extends down the back 15 and along the patient's sides. In the preferred construction, the intermediate portion forms part of the upper or second section 100 and is integrally connected therewith.

The preferred form of intermediate section 120 shown in the drawings includes first, second, third and fourth flexible members which are identified by the numerals 121 through 124, respectively. Members 121–124 are preferably straps made of a suitable material, such as a heavy fabric or strapping material. The strap members are affixed by a suitable means, such as by sewing or appropriate fastening technique to the second or upper portion 100. The first flexible member 121 is a longitudinal member which has a proximal end 130 which is affixed on the first edge 103 of the second portion 100, and an opposite, distal or second end 131. The second flexible member 122 is also a longitudinal member and similarly has a proximal end 132 which is affixed on the first edge 103 of the second portion 100, and has an opposite, second or distal end 133.

The first and second flexible members 121 and 122 both extend down and along the sides of the patient. These members are disposed a suitable distance apart, which is approximately equal to the width of the patient 11. In the preferred form shown, the first and second longitudinal members 121 and 122 are disposed in substantially parallel spaced relationship to one another. They are also preferably oriented in substantially perpendicular relation relative to the first edge 103 and transverse band 161.

The intermediate or middle portion 120 also preferably includes the third and fourth members 123 and 124. Members 123 and 124 support the middle part of the patient's back. They also serve to laterally restrain the lower ends of longitudinal members 121 and 122. The third member 123 has a proximal end 134 which is affixed so as to extend downwardly and across from the first edge 103 of the second portion 100. It also has an opposite, second or distal end 135 which is affixed on the distal end 133 of the second longitudinal member 122. The proximal end 134 is connected near the proximal end 130 of the first flexible member 121. In a similar and complementary construction, the fourth member 124 has a proximal end 136 which is attached to the piece 101 and extends downwardly and across from the first edge 103 of the second portion 100. Member 124 further has an opposite, second, or distal end 137 which is connected near the distal end 131 to the first longitudinal member 121. The proximal end 136 of the fourth member 124 is located near the proximal end 132 of the second member 122. The third and fourth members 123 and 124 are advantageously arranged to cross one another and are preferably affixed together at a cross location or intersection 138 which is substantially intermediate their opposite proximal and distal ends. This physical arrangement of the individual support members 121–124 properly supports and cradles the back 15 of the patient thereby keeping the patient 11 in an appropriate orientation relative to the assembly 10. It also allows easy positioning behind the patient with less lifting and repositioning than with full panels which previously have been inserted across the back of the patient.

The first and second flexible members have a suitable length dimension such that when the first portion 60 is positioned in supporting relation relative to the thighs 16 and buttocks 17 of the person 11, the second portion 100 is oriented in supporting relation to the back and shoulders 14 of the person 11. As will be recognized from a study of FIG. 1, individual detachable couplers 140 are used to join the distal ends 131 and 133 of the first and second longitudinal members 121 and 122 to the first portion. The couplers are to engage the individual grommets 70 which are borne by the first portion 60. As will be recognized by a study of FIG. 1, the different relative position of the grommets 70 allows the first and second longitudinal members 121 and 122 to be attached at various locations to accommodate patients 11 having various body widths and shapes. This construction forms a detachable and adjustable coupling system between the upper and lower parts of the assembly.

The assembly of the present invention in its broadest aspect includes a first or lower portion 60 which supports that part of the person's body 11 below the waist; and a second or upper portion 100 which supports that part of the person's body 11 above the waist. The second portion 100 has first and second longitudinal members 121 and 122 which extend downwardly to detachably join with the first portion 60. The joiner between the first and second members 121 and 122 is preferably adjustable at connection grommets 70. The slender configuration of the longitudinal members 121 and 122 allows them to extend along the patient's sides.

In another aspect of the present invention, the assembly for moving a person comprises a first portion 60 having a flexible main body 61 defined by a first edge 63, an opposite second edge 64 and a pair of laterally disposed edges 65 and 66 which are oriented in substantially parallel, spaced relation, one to the other, and wherein the main body 61 defines individual channels 80 which are coaxially oriented along the laterally disposed edges 65 and 66; a lifting device 90 received in each of the channels 80 which is defined by the flexible main body 61 of the first portion 60; and a second portion 100 having a flexible main body 101 which has a first, and a second opposite edges 103 and 104, and a pair of laterally disposed edges 105 and 106 which are oriented in substantially parallel spaced relation one to the other, and wherein the first and second flexible members 121 and 122 depend downwardly relative to the first edge 103 of the main body 101, each of the flexible members having proximal ends 130 and 132, which is made integral with the first edge 103, and an opposite, distal ends 131 and 133, which is remote thereto, and wherein third and fourth flexible members 123 and 124 depend downwardly relative to the first edge 103 of the main body 101, each of the third and fourth flexible members 123 and 124 having proximal ends 134 and 136, which are made integral with the first edge 103 of the main body 101, and opposite distal ends 135 and 137, and wherein the distal end 135 of the third member 123 is made integral with the distal end 133 of the second flexible member 122, and the distal end 137 of the fourth flexible member 124 is made integral with the distal end 131 of the first flexible member 121, and wherein the third and fourth members 123 and 124 are fastened one to the other at a cross location 138 intermediate their proximate and distal ends, and wherein the first and second flexible members 121 and 122 are releasably affixed on the first portion 60 along the second edge 64 thereof.

OPERATION

The invention further includes novel methods. These methods and the operation of the preferred constructions will now be given. The methods according to this invention preferably include methods for supporting and moving a person using a support assembly such as support assembly 10 described herein. The methods advantageously include selecting or providing a first sling portion such as the first sling portion 60 described hereinabove.

The methods further include positioning the first sling portion under the legs or legs and buttocks of the patient being supported and moved. This is advantageously accomplished by first lifting the thighs of the patient to allow the first sling portion 60 to be positioned adjacent and below the thighs or thighs and buttocks. The patient's legs can then be lowered. The first sling portion is positioned so that the attachment features, such as grommets 70, are adjacent to the patient's upper body or torso.

The novel methods and operation further include selecting a second sling portion, such as second sling portion 100 described hereinabove. The second sling portion is further preferably defined to include the middle portion which serves as a connecting assembly with the first sling portion.

The novel methods further include positioning the second sling portion 100 with attached middle portion 120 behind the upper body of the patient. This can advantageously be accomplished by lifting the shoulder blades of the patient and by positioning the second sling portion across and behind the shoulder blades.

The novel methods further include extending longitudinal connecting members, such as longitudinal flexible members 121 and 122 along opposing sides of the patient.

The novel methods further include connecting the first and second sling portions such as by using connecting couplers 140 which extend between first and second longitudinal members 121 and 122 to join with the first sling portion at grommets 70, or other suitable connecting features.

Another aspect of the present invention includes a method for moving a person 11 comprising providing a first sling portion 60 and positioning the first sling portion 60 in supporting relation relative to the part of the person's body 11 located below the waist 13. The methods also include providing a second sling portion, such as sling portion 100, having first and second longitudinal members 121 and 122 which extend along the patient's sides; the first and second flexible members 121 and 122 releasably affixed on the first sling portion 60, and disposed in supporting relation relative to the back 15 of the person 11. The methods include providing lifting means 20 which attaches to the first and second sling portions 60 and 100 and which operates in combination with the first and second sling portions 60 and 100 to support the person 11 and spaced relation relative to the surface of the earth 21.

When employing the assembly 10, the first portion 60 and second portion 100 are separated or otherwise detached from each other and an attendant, not shown, would position the individual components in appropriate orientations relative to the patient's body 11. Once oriented, the first and second flexible members 121 and 122 would be extended along the outside of the patient's back 15, and would be attached to the first portion 60 at the respective grommets 70. Once this has occurred, the side chain sections 50 would be attached on the assembly 10. In this regard, the individual first chain sections 51 would be releasably secured in the individual grommets 110, which are borne by the second portion 100; and the individual second chain section 52 would be secured on the apex 94, of the individual lifting devices 90. Once the side chains 50 are attached, the boom 30 and the associated lifting beam 40 would be raised by means of the hydraulic ram 55, thereby picking up the person as shown most clearly in FIG. 3. The procedure would be reversed to remove the assembly 10 from beneath the patient 11 once they are at their desired destination.

Thus, the assembly 10 for moving a person 11 of the subject invention provides a convenient means by which a patient 11 can be readily moved from one location to another while undergoing therapy, or the like, and which further provides a convenient means by which the accompanying assembly 10 can be removed from beneath the person once they have been moved to a desired destination. The assembly is further easy to employ, does not substantially interfere with any ongoing therapy, and can be manufactured and sold at a relatively nominal price when compared with the other prior art assemblies.

Although the invention has been herein shown and described in what was conceived to be the most practical and preferred embodiment, it is recognized that the departures may be made therefrom within the scope of the invention which is not to be limited to the illustrative details as disclosed.

What I claim is:

1. An assembly for moving a person, comprising:

a first portion which supports that part of the person's body below the waist;

a second portion which supports that part of the person's body above the waist; said second portion having a transverse section which extends across to support said person along the person's upper back;

an intermediate section which extends between the first portion and second portion; said intermediate section having at least first and second members which are connected to the first portion and second portion so as to extend along the sides of said person when the assembly is installed on the person;

detachable couplers for detachably connecting the first and second members to at least one of said portions;

whereby the first portion can be installed beneath the person's waist by positioning under the person's legs and the second portion can be separately installed behind the person's back, with the intermediate section serving to detachably join the first and second portions so that the assembly can be installed without lifting the waist of the person while in a reclined position.

2. An assembly as claimed in claim 1, wherein the first portion has a flexible main body.

3. An assembly as claimed in claim 1, wherein the second portion has a flexible main body.

4. An assembly as claimed in claim 1, wherein there are lifting devices received in the first portion for distributing lifting forces applied to the first portion, and wherein there are attachment features on the second portion for applying lifting forces to the second portion.

5. An assembly as claimed in claim 1, wherein the first portion has a width dimension which is greater than or equal to the width of the person, and the second portion has a width dimension which is equal to or less than the width dimension of the first portion, and wherein the first and second members are positioned a given distance apart which is greater than or equal to the width of the person.

6. An assembly as claimed in claim 1, wherein the first portion has a width dimension which is greater than or equal to the width of the person, and the second portion has a width dimension which is equal to or less than the width dimension of the first portion, and wherein the first and second members are flexible members positioned a given distance apart which is greater than or equal to the width of the person, and wherein the first and second flexible members each have a proximal end which is secured on the main body of the second portion, and an opposite distal end, and wherein the assembly further includes third and fourth flexible members which each have a proximal end which is secured on the main body of the second portion, and an opposite distal end which is secured on one of the first and second flexible members, and wherein the proximal end of the third member is located adjacent to the proximal end of the first member, and the distal end of the third member is affixed on the distal end of the second member, and wherein the proximal end of the fourth member is positioned adjacent to the proximal end of the second member, and the distal end of the fourth member is secured on the distal end of the first member, and wherein the third and fourth members are affixed to each other at a location intermediate their respective opposite ends.

7. An assembly for moving a person, comprising:

a first portion having a flexible main body with a width dimension which is greater than the width dimension of the person; and a second portion having a flexible main body which has a width dimension which is equal to or less than the width dimension of the first portion, the second portion having first and second flexible members which depend downwardly relative to the first portion, and which have a given length dimension, and wherein the first and second flexible members are spaced a predetermined distance apart which is greater than or equal to the width of the person, and wherein the first and second flexible members are releasably affixed on the first portion, and the given length dimension of the first and second flexible members positions the second portion in supporting relation relative to the shoulders of the person when the first portion is positioned in supporting relation relative to the thighs and buttocks of the person;

wherein the main body of the first portion is defined by a first edge, an opposite second edge, and a pair of laterally disposed edges, and wherein the first and second edges are truncated in shape, and the laterally disposed edges are disposed in substantially parallel spaced relation, one to the other, and wherein a plurality of grommets are borne by the flexible main body and positioned adjacent to the second edge, and wherein the flexible main body defines individual channels which are located along the laterally disposed edges, and wherein each of the first and second members has a fastener which releasably engages one of the grommets borne by the flexible main body.

8. An assembly as claimed in claim 7, wherein individual lifting devices are received in each of the channels defined by the first portion, the individual lifting devices comprising first, second and third sections which are joined together into a substantially triangular shape, and wherein the first section of one of the lifting devices is received in each of the channels, and wherein the second and third sections of the respective lifting devices define an apex.

9. An assembly for moving a person, comprising:

a first portion having a flexible main body with a width dimension which is greater than the width dimension of the person; and a second portion having a flexible main body which has a width dimension which is equal to or less than the width dimension of the first portion, the second portion having first and second flexible members which depend downwardly relative to the first portion, and which have a given length dimension, and wherein the first and second flexible members are spaced a predetermined distance apart which is greater than or equal to the width of the person, and wherein the first and second flexible members are releasably affixed on the first portion, and the given length dimension of the first and second flexible members positions the second portion in supporting relation relative to the shoulders of the person when the first portion is positioned in supporting relation relative to the thighs and buttocks of the person;

wherein the second portion has a first edge, an opposite second edge, and a pair of laterally disposed edges, and wherein the first edge is substantially straight, and the laterally disposed edges are disposed in substantially normal relation relative to the first edge, and wherein a pair of grommets are borne by the second portion and are individually positioned adjacent to the laterally disposed edges, and wherein the first and second flexible members are affixed on the main body of the second portion at the first edge thereof, and wherein the second portion further includes third and fourth flexible members which have opposite ends, the third and fourth members attached at one of their respective ends on the first edge of the second portion, and the opposite ends being attached on the individual first and second flexible members.

10. An assembly for moving a person, comprising:

a first portion having a flexible main body with a width dimension which is greater than the width dimension of the person; and a second portion having a flexible main body which has a width dimension which is equal to or less than the width dimension of the first portion, the second portion having first and second flexible members which depend downwardly relative to the first portion, and which have a given length dimension, and wherein the first and second flexible members are spaced a predetermined distance apart which is greater than or equal to the width of the person, and wherein the first and second flexible members are releasably affixed on the first portion, and the given length dimension of the first and second flexible members positions the second portion in supporting relation relative to the shoulders of the person when the first portion is positioned in supporting relation relative to the thighs and buttocks of the person, wherein the first and second flexible members each have a proximal end which is secured on the main body of the second portion, and an opposite distal end, and wherein the assembly further includes third and fourth flexible members which each have a proximal end which is secured on the main body of the second portion, and an opposite distal end which is secured on one of the first and second flexible members, and wherein the proximal end of the third member is located adjacent to the proximal end of the first member, and the distal end of the third member is affixed on the distal end of the second member, and wherein the proximal end of the fourth member is positioned adjacent to the proximal end of the second members and the distal end of the fourth member is secured on the distal end of the first member, and wherein the third and fourth members are affixed to each other at a location intermediate their respective opposite ends.

11. An assembly for moving a person comprising:

a first portion having a flexible main body defined by a first edge, an opposite second edge, and a pair of laterally disposed edges which are oriented in substantially parallel spaced relation one to the other, and wherein the main body defines individual channels which are coaxially oriented along the laterally disposed edges;

a lifting assembly received in each of the channels defined by the flexible main body of the first portion; and a second portion having a flexible main body which has a first edge, an opposite second edge, and a pair of laterally disposed edges which are oriented in substantially parallel spaced relation one to the other, and wherein second portion further has first and second flexible members which depend downwardly relative to the first edge of the main body, each flexible member having a proximal end which is made integral with the first edge, and an opposite distal end which is remote thereto, and wherein third and fourth flexible members depend downwardly relative to the first edge of the main body, each of the third and fourth flexible members having a proximal end which is made integral with the first edge of the main body, and an opposite distal end, and wherein the distal end of the third member is made integral with the distal end of the second flexible member, and the distal end of the fourth member is made integral with the distal end of the first flexible member, and wherein the third and fourth members are fastened one to the other at a location intermediate their respective proximal and distal ends, and wherein the first and second flexible members are releasably affixed on the first portion along the second edge thereof.

12. An assembly as claimed in claim 11, wherein the assembly is operable to move a non-ambulatory person from one location to another, and wherein the flexible main body of the first portion has a given width dimension which is greater than the width dimension of the person, and a length dimension which permits it to be positioned in supporting relation under the buttocks and thighs of the person.

13. An assembly as claimed in claim 11, wherein each of the lifting devices has first, second and third sections which are integrally formed together into a triangular shape, and wherein the first section of each of the lifting assemblies are received in the individual channels defined by the flexible main body of the first portion.

14. An assembly as claimed in claim 12, wherein the second portion has a given length and width dimension, and wherein the width dimension of the second portion is less than or equal to the width dimension of the first portion, and wherein the first and second flexible members have a given length dimension, and are further spaced a predetermined distance apart which is greater than or equal to the width dimension of the person, and wherein the length dimension of the individual first and second flexible members positions the second portion in supporting relation relative to the shoulders of the person when the first portion is located in supporting relation under the buttocks and thighs of the person.

15. An assembly as claimed in claim 12, wherein four apertures are formed in the main body of the first portion, and wherein two of the four apertures are located in a position near one of the laterally disposed edges and along the second edge thereof, and the other two apertures are located in a position near the opposite laterally disposed edge and along the second edge thereof, and wherein the two pairs of apertures are located a given distance apart which is greater than or equal to the width of the person, and wherein the first and second flexible members each have a fastener which is received in one of the apertures defined by the first portion.

16. An assembly as claimed in claim 11, wherein a fastener is borne on the distal end of each of the flexible members and is operable to releasably engage the first portion.

17. A method for supporting and moving a person who is in a reclined position upon a supporting surface, comprising:

providing a first sling portion;

lifting at least portions of the person's legs and thighs from the supporting surface;

positioning the first sling portion under the person's thighs while the person's legs and thighs are so lifted, to position the first sling portion in supporting relationship relative to the part of the person's body located below the waist;

providing a second sling portion having a transverse section which is configured to extend across the upper back of the person;

lifting the person's upper back;

positioning the second sling portion under the person's upper back while the person's upper back is so lifted, to position the second sling portion in supporting relationship relative to the part of the person's body located above the waist;

extending first and second flexible members along opposing sides of the person;

connecting the first sling portion and second sling portion together using detachable couplers which are connected to the first and second flexible members;

providing lifting means which attaches to the first and second sling portions lifting the person supported by the first and second sling portions from the supporting surface.

18. An assembly for moving a person, comprising:

a first portion which supports that part of the person's body below the waist; and a second portion which supports that part of the person's body above the waist, the second portion having first and second members which extend to detachably connect with the first portion;

wherein the first portion has a width dimension which is greater than or equal to the width of the person, and the second portion has a width dimension which is equal to or less than the width dimension of the first portion, and wherein the first and second members are flexible members positioned a given distance apart which is greater than or equal to the width of the person, and wherein the first and second flexible members each have a proximal end which is secured on the main body of the second portion, and an opposite distal end, and wherein the assembly further includes third and fourth flexible members which each have a proximal end which is secured on the main body of the second portion, and an opposite distal end which is secured on one of the first and second flexible members, and wherein the proximal end of the third member is located adjacent to the proximal end of the first member, and the distal end of the third member is affixed on the distal end of the second member, and wherein the proximal end of the fourth member is positioned adjacent to the proximal end of the second member, and the distal end of the fourth member is secured on the distal end of the first member, and wherein the third and fourth members are affixed to each other at a location intermediate their respective opposite ends.

* * * * *